US010702010B2

(12) United States Patent
Tersigni

(10) Patent No.: US 10,702,010 B2
(45) Date of Patent: Jul. 7, 2020

(54) CONDUIT FOR DISCHARGING STATIC ELECTRICITY THROUGH THE SOLE OF A SHOE

(71) Applicant: Antonio Tersigni, Bs As (AR)

(72) Inventor: Antonio Tersigni, Bs As (AR)

(73) Assignee: Antonio Tersigni, Edmonds, WA (US)

( * ) Notice: Subject to any disclaimer, the term of this patent is extended or adjusted under 35 U.S.C. 154(b) by 289 days.

(21) Appl. No.: 15/904,141

(22) Filed: Feb. 23, 2018

(65) Prior Publication Data

US 2018/0235313 A1 Aug. 23, 2018

Related U.S. Application Data

(60) Provisional application No. 62/462,690, filed on Feb. 23, 2017.

(51) Int. Cl.

| | |
|---|---|
| ***A43B 7/36*** | (2006.01) |
| ***H01B 1/12*** | (2006.01) |
| ***H05F 3/02*** | (2006.01) |
| ***H01B 1/24*** | (2006.01) |

(52) U.S. Cl.

CPC ..... *A43B 7/36* (2013.01); *H01B 1/12* (2013.01); *H01B 1/24* (2013.01); *H05F 3/02* (2013.01)

(58) Field of Classification Search

CPC .... A43B 7/36; H01B 1/12; H01B 1/24; H05F 3/02

See application file for complete search history.

(56) References Cited

U.S. PATENT DOCUMENTS

| | | | | |
|---|---|---|---|---|
| 3,544,841 | A * | 12/1970 | Peel | A43B 7/36 361/224 |
| 4,727,452 | A * | 2/1988 | Brownlee | A43B 7/36 361/220 |
| 5,653,047 | A * | 8/1997 | Franey | A43B 7/36 36/136 |
| 7,471,497 | B1 * | 12/2008 | Knight, Sr. | A43B 7/36 361/212 |
| 2003/0118372 | A1 * | 6/2003 | Kitano | G03G 15/0233 399/176 |
| 2007/0000155 | A1 * | 1/2007 | Laufer | A43B 7/36 36/136 |

(Continued)

*Primary Examiner* — Scott Bauer
(74) *Attorney, Agent, or Firm* — Antonio Tersigni; Pro SE

(57) ABSTRACT

A conduit for discharging excess static electricity through the sole of a shoe has a base a compressible central cylinder, a cap coupler, a detachable cap, and a coupler-receiving receptacle. The base, the compressible central cylinder, the cap coupler, and the detachable cap are all composed of compressible conductive materials. This enables the conduit for electrical discharge to be compressed, when a user takes a step. The base is terminally connected to the compressible central core, opposite to the cap coupler. The coupler-receiving receptacle traverses through the detachable cap, and the cap coupler engages into the coupler-receiving receptacle. This enables the detachable cap to function as an endcap that clamps the sole of the shoe between the base and the detachable cap. As a result, the detachable cap comes into contact with the user's foot and discharges static electricity through the compressible central core and the base, into the ground.

13 Claims, 7 Drawing Sheets

(56) References Cited

U.S. PATENT DOCUMENTS

2008/0289217 A1* 11/2008 Horvath ..... A43B 3/108
36/88
2011/0030243 A1* 2/2011 Tersigni ..... A43B 7/36
36/103

* cited by examiner

CONDUIT FOR DISCHARGING STATIC ELECTRICITY THROUGH THE SOLE OF A SHOE

The current application claims a priority to the U.S. Provisional Patent application Ser. No. 62/462,690 filed on Feb. 23, 2017.

FIELD OF THE INVENTION

The present invention relates generally to an antistatic device. More specifically, the present invention relates to a conduit that channels static electricity out of a user's body and into a grounded surface.

BACKGROUND OF THE INVENTION

As it is known, the human body behaves like a capacitor and the source of generation is triboelectricity as a result of friction in our actions throughout the day. Thus, the human body, in conjunction with any clothing being worn, acts as a voltage source, a capacitor, as well as several linear and nonlinear resistors. Because each human is unique there are many environmental and structural variables that affect the electrical characteristics of an individual's body.

The present invention is able to control these series of variables in a way that can counteract the effects produced by the buildup of static electricity in a user's body. Specifically, the present invention enables the rapid discharge of static electricity from a user's body. Thus, the present invention is able to maintain the charge stored in the user's body below 10V by discharging any excess static electricity in tenths of a second.

The human body is considered a to be a capacitor of 100 to 200 pico-farads. This value, is normally taken by representing the human body as a cylinder with a one-meter length and a sixty-centimeter diameter. However, this representation does not take into account the clothing worn by an individual. When the individual's clothing is factored into the representation of the human body, the resistance range of an antistatic device must be modified.

In practice, in the areas called EPA (Electrostatic Protected Areas), the recommended resistance range is 0.75 mega-Ohms to 35 mega-Ohms. This value presents a lower limit of the resistance of the human body. Because of this, antistatic devices must be designed with a relatively low resistance of 2.5 mega-Ohms.

In order to solve this problem, various types of footwear that have been labeled as antistatic have been launched in the market but do not comply with these parameters. Accordingly, the present invention is encapsulated in the sole of a shoe and is designed to maintain a resistance of 2.5 mega-Ohms. This guarantee a piece of footwear retains antistatic capabilities throughout its useful life, even when the shoe is filled with water.

Precisely, the other variables that will be detailed below, raise the resistance value of the present invention to 30 mega-Ohms. However, this value decreases throughout the day. Further, the structural elements of a piece of footwear, with the presence of the human foot, behave as if it were an electrolytic cell, where there is ion circulation. This causes a reduction of structural and working resistance. Additionally, structural and working resistance can be reduced depending on the humidity, temperature, acidity, salinity of the system and the person's weight. This present invention is designed to be a robust device that will not degrade during the life of the shoe. To achieve this, the present invention is composed of an alloy of four types of natural and synthetic rubber. Additionally, the present invention may employ polyurethane as an antimicrobial coating.

DETAIL DESCRIPTIONS OF THE INVENTION

All illustrations of the drawings are for the purpose of describing selected versions of the present invention and are not intended to limit the scope of the present invention.

Referring to FIG. 1 through FIG. 7, the preferred embodiment of the present invention, the conduit for discharging static electricity through the sole of a shoe, is an antistatic device that, when inserted through the sole of a shoe, enables the rapid discharge of any static electricity that is stored in a user's body. The present invention functions as both a safety precaution and a personal wellness device. Specifically, discharging the static electricity stored in a user's body prevents the user from inadvertently igniting volatile chemicals that may be present in the ambient air. Further, discharging static electricity, improves the electrical balance of the user's body; thus, promoting overall health and wellness. To accomplish this, the present invention is constructed as a compressible cylinder that extends through the sole of the user's shoe. Thus positioned, the present invention is able to conduct static electricity out of the user's body and into the surface on which the user walks. Further, the present invention acts as a passive discharge system that does not require any active engagement from the user. Because the present invention is composed of compressible materials, the user does not experience discomfort while wearing a shoe that is equipped with the present invention. Although the present invention is described as being positioned within the sole of a shoe, the present invention can be used to discharge electrical currents in a variety of situations where the discharge of stored static electricity is beneficial. For example, rather than being attached to a shoe, the present invention may be integrated into the seats on an airplane. In this example, the passengers constantly discharge static electricity into the seats of the airplane.

Figure 1:
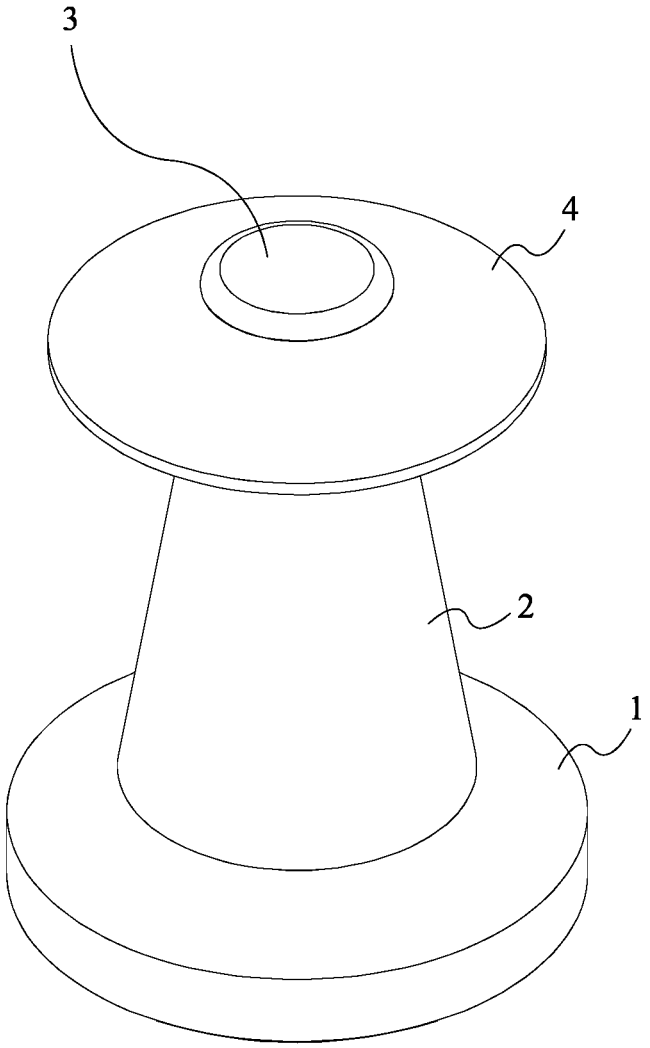
FIG. 1 is a perspective view of the present invention.
Figure 4:
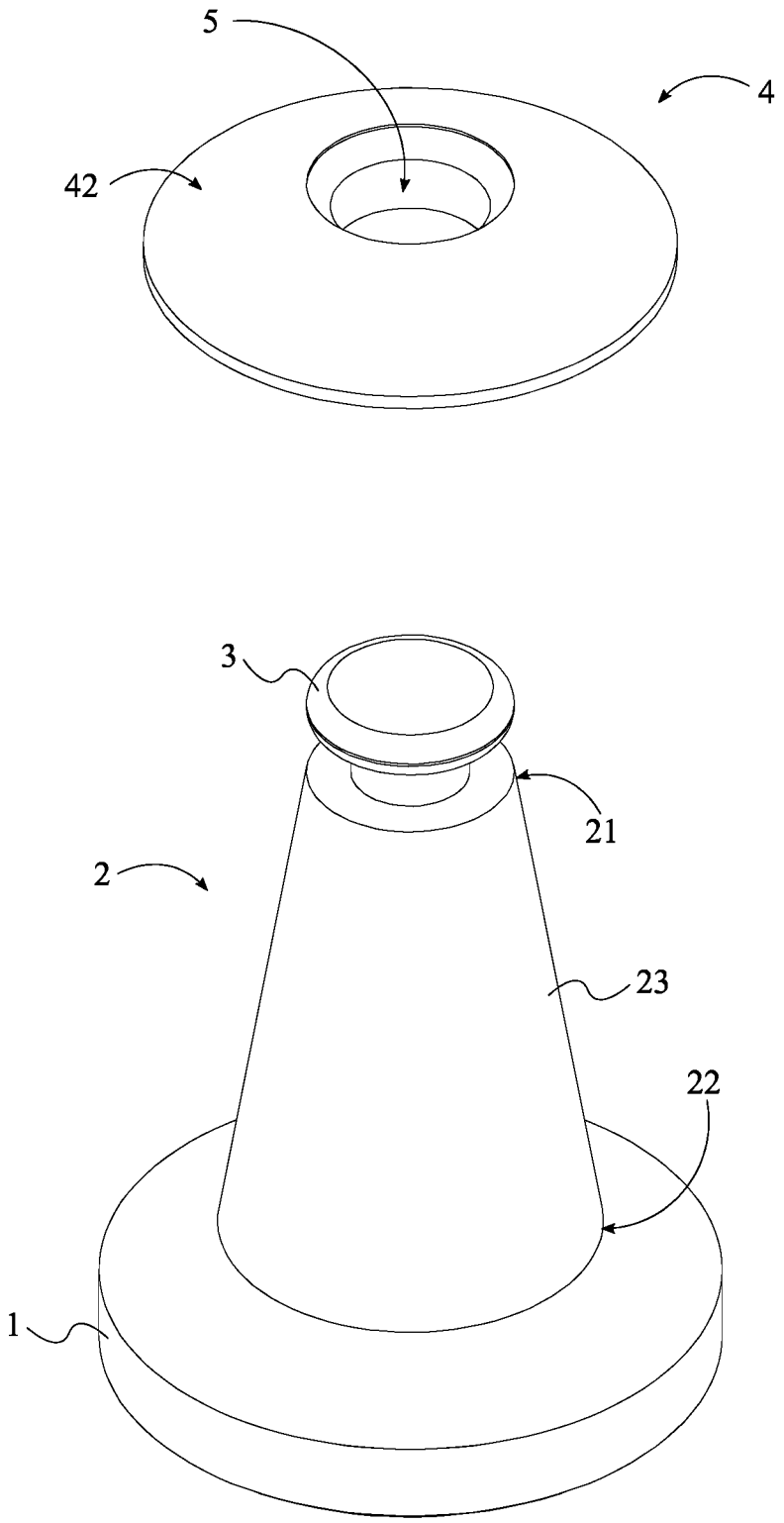
FIG. 4 is an exploded perspective view of the present invention.

Referring to FIG. 1 and FIG. 4, the present invention is able to achieve the aforementioned functionality by comprising a base 1, a compressible central cylinder 2, a cap coupler 3, a detachable cap 4, and a coupler-receiving receptacle 5. The base 1, the compressible central cylinder 2, the cap coupler 3, and the detachable cap 4 are all conductive members that can be deformed under an externally applied force. Preferably, the compressible central cylinder 2 is oriented normal to the ground on which the user walks. Further, the compressible central cylinder 2 traverses through the sole of the shoe, from the insole to the outsole.

This enables the compressible central cylinder 2 to act as a conduit for static electricity when the user's shoe is resting on the ground. The base 1 is a conductive terminal that is positioned adjacent to the outsole of the shoe. Additionally, the base 1 is terminally connected to the compressible central cylinder 2. Consequently, the base 1 comes into contact with the ground on which the user stands. Further, the base 1 serves as a terminal that discharges static electricity whenever the user's shoe is in contact with the ground. The cap coupler 3 is terminally connected to the compressible central cylinder 2, opposite to the base 1. As a result, the detachable cap 4 can be both mechanically and electrically connected to the compressible central cylinder 2. The detachable cap 4 is a conductive terminal that is positioned adjacent to the insole of the user's shoe and serves as the inlet for static electricity that is stored within the user's body. The coupler-receiving receptacle 5 concentrically traverses through the detachable cap 4 so that the detachable cap 4 can be attached to the compressible central cylinder 2. Specifically, the cap coupler 3 is engaged within the coupler-receiving receptacle 5. As a result, the detachable cap 4 is able to function as a connection flange which clamps the sole of the shoe between the base 1 and the detachable cap 4. This prevents the present invention from becoming detached from the user's shoe. Additionally, because all of the components of the present invention are electrically conductive, the detachable cap 4, the cap coupler 3, the compressible central cylinder 2, and the base 1 are electrically connected to each other. Consequently, static electricity is able to travel from the user's body, into the detachable cap 4, through the cap coupler 3 and the compressible central cylinder 2 and be discharged into the ground by the base 1. This enables the present invention to serve as a conduit through which static electricity is discharged from the user's body.

Figure 2:
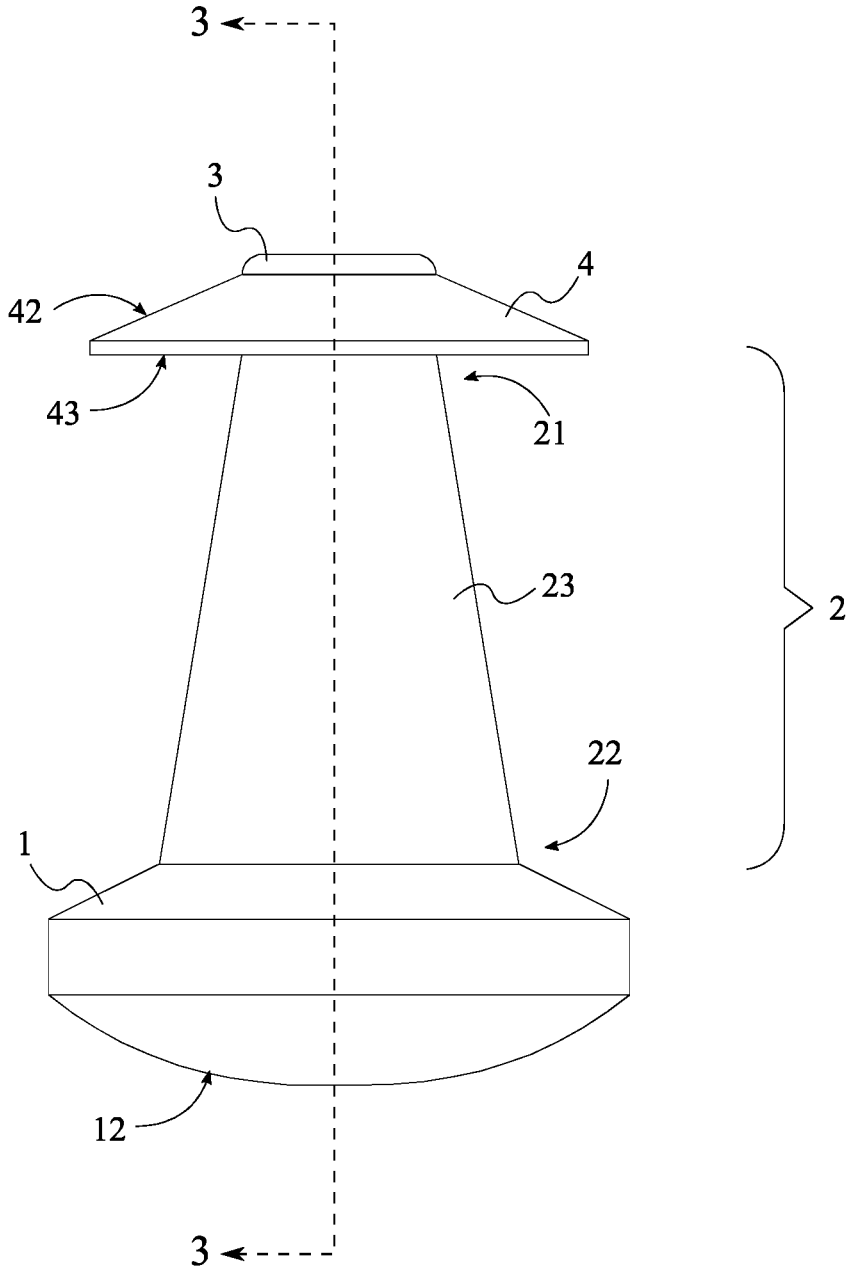
FIG. 2 is a front view of the present invention.
Figure 6:
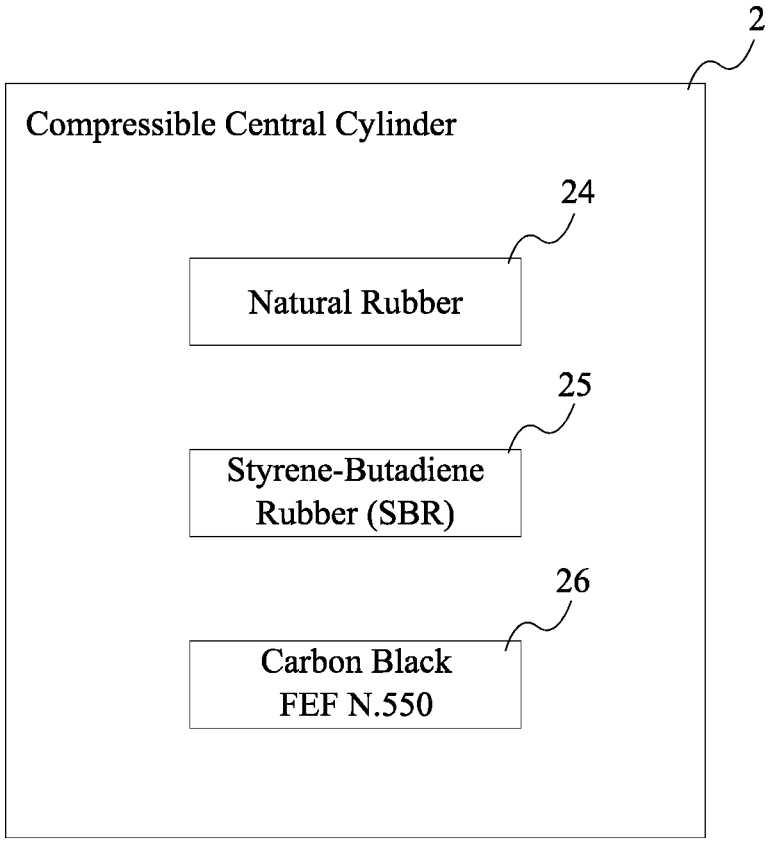
FIG. 6 is a block diagram depicting the ingredients of the material used to make the compressible central cylinder in present invention.

Referring to FIG. 2 and FIG. 6, as described above, the compressible central cylinder 2 can be deformed by an externally applied force. More specifically, the overall length of the compressible central cylinder 2 decreases when the user's shoe is in contact with the ground and increases when the user's shoe is lifted off of the ground. To achieve this, the compressible central cylinder 2 comprises a first length-adjustable end 21, a second length-adjustable end 22, and a cylinder body 23. The first length-adjustable end 21 and the second length-adjustable end 22 are deformable portions of the compressible central cylinder 2 that function as the connection points for the base 1 and the cap coupler 3. Further, the first length-adjustable end 21 is positioned adjacent to the cylinder body 23, opposite to the second length-adjustable end 22. Accordingly, the first length-adjustable end 21 and the second length-adjustable end 22 are able to absorb a portion of the compressive forces applied to the present invention. This enables the present invention to function without causing discomfort to the user. Preferably, the first length-adjustable end 21, the second length-adjustable end 22, and the cylinder body 23 are composed of mixtures of conductive rubber materials. Specifically, the compressible central cylinder 2 is composed of a mixture comprising a quantity of natural rubber 24, a quantity of styrene-butadiene rubber (SBR) 25, and a quantity of carbon black fast extruding furnace (FEF) N550 26. This enables the compressible central cylinder 2 to retain a desired electrical resistance value while compressed or decompressed. The cap coupler 3 is adjacently connected to the first length-adjustable end 21, opposite to the cylinder body 23. As a result, the cap coupler 3 is maintained in a position that enables the detachable cap 4 to be attached to the compressible central cylinder 2 while the detachable cap 4 is positioned within the user's shoe. Conversely, the base 1 is adjacently connected to the second length-adjustable end 22, opposite to the cylinder body 23. Thus connected, the base 1 is positioned outside of the user's shoe and able to come into contact with the ground. Further, the position of the base 1 enables the base 1 to discharge static electricity into the ground. The compressible central cylinder 2 is preferably shaped as a tapered member that tapers from the base 1 to the cap coupler 3. As a result, the base 1 has a large surface area through which to discharge static electricity.

Figure 3:
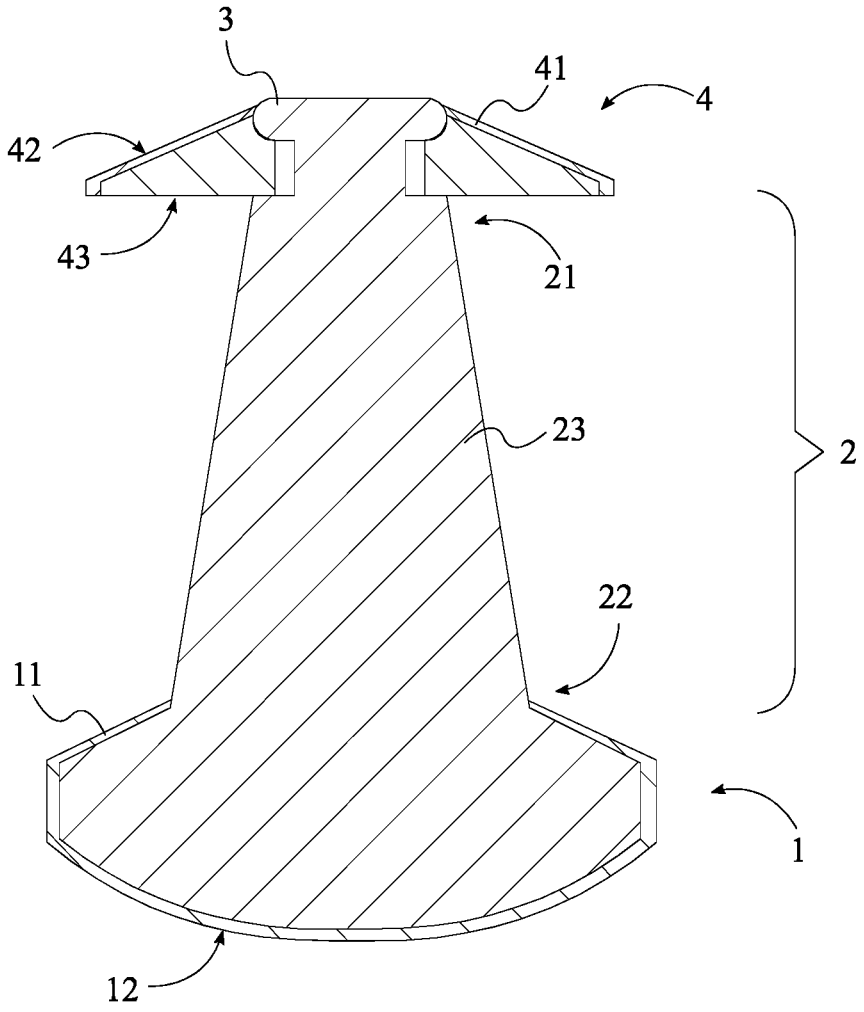
FIG. 3 is a left-side view of the present invention taken along line 3-3 in FIG. 2.

Referring to FIG. 2 and FIG. 3, because the base 1 comes into contact with the ground and the detachable cap 4 comes into contact with the user's foot, the base 1 and the detachable cap 4 must be treated to prevent corrosion. The base 1 and the detachable cap 4 must also be treated to prevent the accumulation of unwanted oils and biological materials. To address this, the present invention further comprises a first oil-resistant coating 11 and a second oil-resistant coating 41. The first oil-resistant coating 11 is superimposed onto the base 1. Similarly, the second oil-resistant coating 41 is superimposed onto the detachable cap 4. Thus positioned, the first oil-resistant coating 11 and the second oil-resistant coating 41 are able to prevent the accumulation of unwanted substances on the surfaces of the base 1 and the detachable cap 4 without hindering the conductivity of the present invention. Additionally, the first oil-resistant coating 11 and the second oil-resistant coating 41 are composed of antimicrobial materials which inhibit the growth of unwanted microorganisms.

Figure 5:
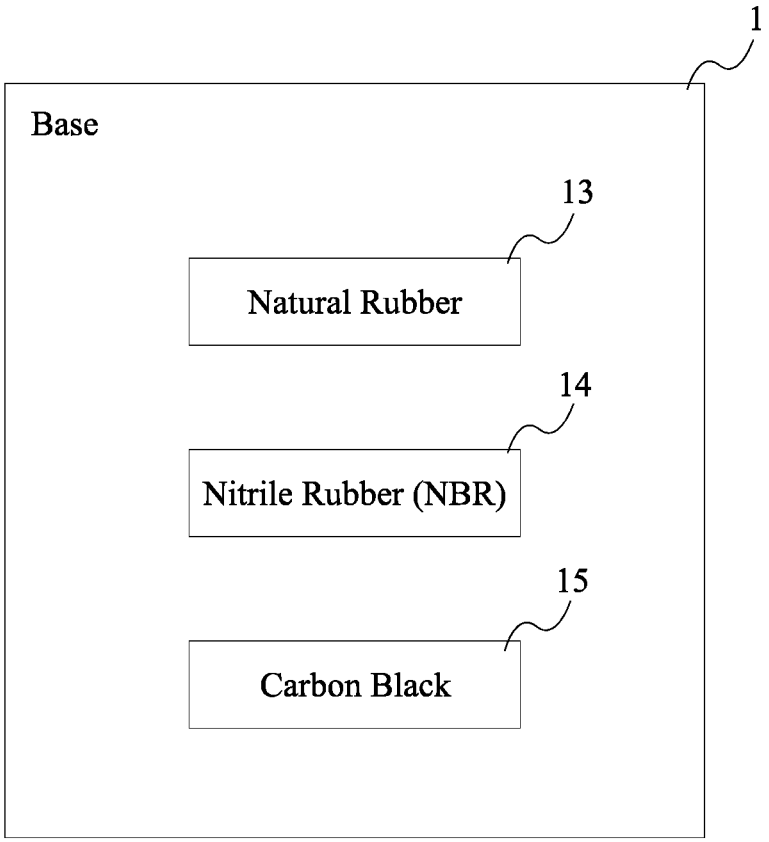
FIG. 5 is a block diagram depicting the ingredients of the material used to make the base in present invention.

Referring to FIG. 3 and FIG. 5, as described above, the base 1 is used to discharge static electricity into the ground. To accomplish this, the present invention comprises a discharge surface 12. The discharge surface 12 is positioned adjacent to the base 1, opposite to the compressible central cylinder 2. Accordingly, the discharge surface 12 comes into contact with the ground on which the user walks. The present invention provides a base 1 that is composed of mixtures of conductive rubber materials. Specifically, the base 1 is composed of a mixture comprising a quantity of natural rubber 13, a quantity of nitrile rubber (NBR) 14, and a quantity of carbon black 15. Accordingly, the base 1 maintains a desired electrical conductivity and resistance while compressed or decompressed.

Figure 7:
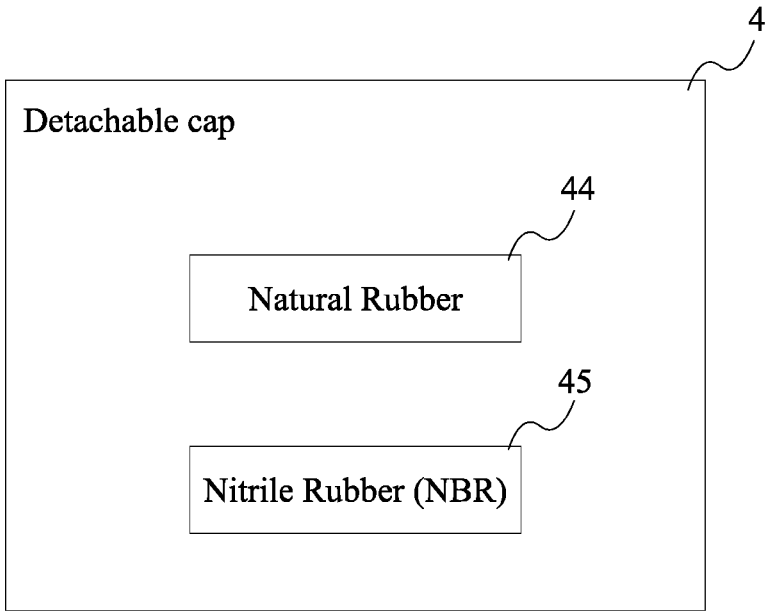
FIG. 7 is a block diagram depicting the ingredients of the material used to make the detachable cap in present invention.

Referring to FIG. 2, FIG. 4, and FIG. 7, the detachable cap 4 is designed to facilitate the transmission of static electricity out of the user's body and into the compressible central cylinder 2. To achieve this, the detachable cap 4 comprises a contact surface 42 and a connection surface 43. The contact surface 42 is positioned opposite to the connection surface 43, across the detachable cap 4. As a result, the contact surface 42 is maintained in a position that enables the contact surface 42 to come into contact with the user's foot. Similarly, the connection surface 43 is maintained in a position that enables the contact surface 42 to come into contact with the compressible central cylinder 2. Further, the coupler-receiving receptacle 5 traverses through the detachable cap 4 from the connection surface 43 to the connection surface 43. Accordingly, the coupler-receiving receptacle 5 enables the cap coupler 3 to form bot a mechanical and electrical connection with the detachable cap 4. The present invention provides a detachable cap 4 that is composed of mixtures of conductive rubber materials. Specifically, the detachable is composed of a mixture comprising a quantity of natural rubber 44 and a quantity of NBR 45. Accordingly, the detachable maintains a desired electrical conductivity and resistance while compressed or decompressed.

Although the invention has been explained in relation to its preferred embodiment, it is to be understood that many other possible modifications and variations can be made without departing from the spirit and scope of the invention as hereinafter claimed.

Supplemental Descriptions of the Invention

For the purposes specified, and taking into account the human body already mentioned, the resistance to electrical discharges from the human body, taken as a capacitor, is the sum of a series of variable factors.

These factors include:

1. Surface resistance of a foot. This varies according to the person, man or woman and even more so if the person suffers from hyper hydrolysis or hypo hydrolysis.
2. The contact resistance between the foot and a sock. This depends on the amount of cotton that the sock and the weight of the user.
3. The resistance of the sock. This depends heavily on the material, whether or not it is hygroscopic, thickness, and if the user uses more than one sock.
4. The contact resistance between the sock and the insole of the shoe. This depends on the moisture absorption capacity of the inner insole and the manufacturing processes used to craft the insole.
5. The resistance of the inner insole.
6. The contact resistance of the inner insole and the assembly insole. In this case the most used materials are the STROBEL stencils along with pressed cardboard. These materials are measured on the workbench and are insulators with a resistance above 200 mega-Ohms. However, all change their conductivity after ten minutes of use as footwear.
7. The strength of the assembly insole. This initial value depends on the thickness, the material, the aqueous and saline environment, and the temperature of the foot. As with all electrolytes, the higher the temperature, the lower the resistance. This is what is measured within a few minutes of wearing the footwear.
8. The contact resistance of the insole assembly with the present invention. This resistance is the one that stays at the limit throughout the day. However, in parallel with all the mentioned resistances, there is the resistance of the inner coating of the footwear and the toe cap of the footwear. Additionally, the material of the insole assembly is usually chosen specially to promote the circulation of foot moisture. This means that with this single resistance, all previous materials are short-circuited.

The present invention can be characterized by describing three specific attributes. Namely, mechanical attributes, chemical attributes, and electrical attributes.

Mechanical:

Since all soles of footwear do not have the same thickness, the present invention must have two areas. The core area is solid and contains all the electrical safety, thus is protected and melted in the sole during the process of pressing the rubber or injected with other types of synthetic. PU, PVC, TR, TPU, etc. At the ends, there are protuberances that increase the core's total length by five millimeters, or whatever is necessary. This gives the present invention the proper tightening to be mechanically affixed to the sole of the shoe. The increase in length allows the present invention to be fixed mechanically during the process of making the soles by squeezing present invention against the walls of the sole matrix. It is important to note that modifying the quality of the rubber of the present invention when being vulcanized, allows the present invention to be compressed to the thickness of the sole, and then recover a desired shape when decompressed. Thus, ensuring a good contact with the floor and the assembly insole.

Chemical:

The present invention consists of multiple kinds of rubber: The rubber on the base that comes in contact with the floor is NBR with carbon black VULCAN XC72 at 40%. This composition creates a conductive oil-resistant surface. The solid mass of the core, has natural rubber at 60% and SBR 40% with carbon black FEF 550. at 40%. This composition creates a core with a desired compressibility and electrical conductivity. Further the composition provides a low cost and easily accessible material. This has been a great discovery because no one recommends the FEF 550 as being suitable for conductive rubbers. The contact cap that is positioned within the shoe and connected to the central core opposite to the base, is composed of a mixture of SBR and VULCAN XC72. This creates a compressible, conductive, and oil resistant inner contact cap.

Electrical:

The structure of present invention consists of three resistors in series and in turn in series with all the resistances mentioned above. The resistance of the inner surface is low and is within 20 kilo-Ohms, to ensure a good contact with the assembly insole. The strength of the core is what really guarantees safety. Regardless of the value of the resistance of the device measured on the work table, what counts is the special result under stress as a result of the tightening in the sole. Accordingly, the resistance of the core is 2.5 mega-Ohms.

In addition to the mechanical, chemical, and electrical attributes of the present invention, the device is designed to be aesthetically pleasing. Accordingly, the present invention is designed with a logo that is positioned on the contact surface of the base. Additionally, for industrial footwear, it is recommended to place three instances of the present invention at the heel, the arc, and the tip of the shoe. In the arch is for example when the worker is on a ladder replenishing merchandise, in the sole is important in the continuously walking and especially when you climb up a carpeted staircase and at the tip when the worker is sitting and tips toe. The three contacts are never discharging simultaneously, therefore they are not connected in parallel.

What is claimed is:

1. A conduit for discharging static electricity through the sole of a shoe comprising:

a base;

a compressible central cylinder;

a cap coupler;

a detachable cap;

a coupler-receiving receptacle;

the base being terminally connected to the compressible central cylinder;

the cap coupler being terminally connected to the compressible central cylinder, opposite to the base;

the coupler-receiving receptacle concentrically traversing through the detachable cap;

the cap coupler being engaged within the coupler-receiving receptacle;

the detachable cap, the cap coupler, the compressible central cylinder, and the base being electrically connected to each other;

wherein the base is composed of a mixture comprising a quantity of natural rubber, a quantity of nitrile rubber (NBR), and a quantity of carbon black:

wherein the compressible central cylinder is composed of a mixture comprising a quantity of natural rubber, a quantity of styrene-butadiene rubber (SBR), and a quantity of carbon black fast extruding furnace (FEF) N550; and wherein the detachable cap is composed of a mixture comprising a quantity of natural rubber and a quantity of nitrile rubber (NBR).

2. The conduit for discharging static electricity through the sole of a shoe as claimed in claim 1 comprising:

the compressible central cylinder comprises a first length-adjustable end, a second length-adjustable end and a cylinder body;

the first length-adjustable end being positioned adjacent to the cylinder body, opposite to the second length-adjustable end;

the cap coupler being adjacently connected to the first length-adjustable end, opposite to the cylinder body; and the base being adjacently connected to the second length-adjustable end, opposite to the cylinder body.

3. The conduit for discharging static electricity through the sole of a shoe as claimed in claim 1 comprising, wherein the compressible central cylinder tapers from the base to the cap coupler.

4. The conduit for discharging static electricity through the sole of a shoe as claimed in claim 1 comprising:

a first oil-resistant coating; and the oil-resistant coating being superimposed onto the base.

5. The conduit for discharging static electricity through the sole of a shoe as claimed in claim 1 comprising:

a second oil-resistant coating; and the second oil-resistant coating being superimposed onto the detachable cap.

6. The conduit for discharging static electricity through the sole of a shoe as claimed in claim 1 comprising:

a discharge surface; and the discharge surface being positioned adjacent to the base, opposite to the compressible central cylinder.

7. The conduit for discharging static electricity through the sole of a shoe as claimed in claim 1 comprising:

the detachable cap comprises a contact surface and a connection surface;

the contact surface being positioned opposite to the connection surface, across the detachable cap; and the coupler-receiving receptacle traversing through the detachable cap from the connection surface to the connection surface.

8. A conduit for discharging static electricity through the sole of a shoe comprising:

a base;

a compressible central cylinder;

a cap coupler;

a detachable cap;

a coupler-receiving receptacle;

the compressible central cylinder comprises a first length-adjustable end, a second length-adjustable end and a cylinder body;

the base being terminally connected to the compressible central cylinder;

the cap coupler being terminally connected to the compressible central cylinder, opposite to the base;

the coupler-receiving receptacle concentrically traversing through the detachable cap;

the cap coupler being engaged within the coupler-receiving receptacle;

the detachable cap, the cap coupler, the compressible central cylinder, and the base being electrically connected to each other;

the first length-adjustable end being positioned adjacent to the cylinder body, opposite to the second length-adjustable end;

the cap coupler being adjacently connected to the first length-adjustable end, opposite to the cylinder body;

the base being adjacently connected to the second length-adjustable end, opposite to the cylinder body;

wherein the base is composed of a mixture comprising a quantity of natural rubber, a quantity of nitrile rubber (NBR), and a quantity of carbon black;

wherein the compressible central cylinder is composed of a mixture comprising a quantity of natural rubber, a quantity of styrene-butadiene rubber (SBR), and a quantity of carbon black fast extruding furnace (FEF) N550; and wherein the detachable cap is composed of a mixture comprising a quantity of natural rubber and a quantity of nitrile rubber (NBR).

9. The conduit for discharging static electricity through the sole of a shoe as claimed in claim 8 comprising, wherein the compressible central cylinder tapers from the base to the cap coupler.

10. The conduit for discharging static electricity through the sole of a shoe as claimed in claim 8 comprising:

a first oil-resistant coating; and the oil-resistant coating being superimposed onto the base.

11. The conduit for discharging static electricity through the sole of a shoe as claimed in claim 8 comprising:

a second oil-resistant coating; and the second oil-resistant coating being superimposed onto the detachable cap.

12. The conduit for discharging static electricity through the sole of a shoe as claimed in claim 8 comprising: a discharge surface; and the discharge surface being positioned adjacent to the base, opposite to the compressible central cylinder.

13. The conduit for discharging static electricity through the sole of a shoe as claimed in claim 8 comprising:

the detachable cap comprises a contact surface and a connection surface;

the contact surface being positioned opposite to the connection surface, across the detachable cap; and the coupler-receiving receptacle traversing through the detachable cap from the connection surface to the connection surface.

* * * * *